US009360809B2

(12) United States Patent
Katada

(10) Patent No.: US 9,360,809 B2
(45) Date of Patent: Jun. 7, 2016

(54) IMAGE FORMING APPARATUS

(71) Applicant: Konica Minolta, Inc., Tokyo (JP)

(72) Inventor: Kazunori Katada, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/829,125

(22) Filed: Aug. 18, 2015

(65) Prior Publication Data

US 2016/0091842 A1 Mar. 31, 2016

(30) Foreign Application Priority Data

Sep. 25, 2014 (JP) ..... 2014-195396

(51) Int. Cl.
*G03G 15/20* (2006.01)
*G03G 15/00* (2006.01)

(52) U.S. Cl.
CPC ..... *G03G 15/2028* (2013.01); *G03G 15/2064* (2013.01); *G03G 15/2078* (2013.01); *G03G 15/2085* (2013.01); *G03G 15/657* (2013.01); *G03G 2215/2045* (2013.01)

(58) Field of Classification Search
CPC ..... G03G 15/00
USPC ..... 399/68, 288
See application file for complete search history.

(56) References Cited

U.S. PATENT DOCUMENTS 8,449,104 B2 * 5/2013 Okazawa ..... B41J 11/0095 100/29
2006/0115313 A1 * 6/2006 Shaw, III ..... B41J 11/42 400/621
2009/0317102 A1 * 12/2009 Hasegawa ..... G03G 15/2039 399/45
2010/0098445 A1 * 4/2010 Negishi ..... G03G 15/50 399/43
2011/0051162 A1 * 3/2011 Okada ..... G06K 15/1884 358/1.12
2011/0262202 A1 * 10/2011 Izumi ..... B41J 15/04 400/621
2012/0057913 A1 * 3/2012 Kawachi ..... B65H 9/006 399/394
2012/0153000 A1 * 6/2012 Hata ..... B41J 11/009 226/168
2015/0063846 A1 * 3/2015 Fukai ..... G03G 15/2067 399/45
2015/0241821 A1 * 8/2015 Fukai ..... G03G 15/205 399/70

FOREIGN PATENT DOCUMENTS

JP 2008-133770 * 10/2008 ..... G03G 15/00
JP 2008233770 A 10/2008

* cited by examiner

*Primary Examiner* — Clayton E Laballe
*Assistant Examiner* — Kevin Butler
(74) *Attorney, Agent, or Firm* — Lucas & Mercanti, LLP

(57) ABSTRACT

An image forming apparatus includes: a sheet conveyance section configured to convey a long sheet; a toner image forming section configured to form a toner image on the long sheet conveyed by the sheet conveyance section; a fixing section configured to fix the toner image formed by the toner image forming section on the long sheet; and an information presenting section configured to display information relating to sheet conveyance, the information relating to sheet conveyance including waste sheet information indicating a conveyance amount of the long sheet conveyed by the sheet conveyance section during a non-image formation period.

9 Claims, 7 Drawing Sheets

AMOUNT OF SHEET REQUIRED FOR OPERATIONS M1
OTHER THAN IMAGE FORMATION IS **m

CONSUMPTION AMOUNT OF ROLL SHEET M2
CAN BE SAVED BY CUTTING ROLL SHEET
AFTER PRINTING IS COMPLETED
TO CUT ROLL SHEET, PRESS SHEET-CUTTING BUTTON

FIG. 7A

REMAINING SHEET M3
CONSUMPTION AMOUNT IS **m

CONSUMPTION AMOUNT OF ROLL SHEET M2
CAN BE SAVED BY CUTTING ROLL SHEET
AFTER PRINTING IS COMPLETED
TO CUT ROLL SHEET, PRESS SHEET-CUTTING BUTTON

FIG. 7B

IMAGE FORMING APPARATUS

CROSS REFERENCE TO RELATED APPLICATIONS

This application is entitled to and claims the benefit of Japanese Patent Application No. 2014-195396, filed on Sep. 25, 2014, the disclosure of which including the specification, drawings and abstract is incorporated herein by reference in its entirety.

BACKGROUND OF THE INVENTION

1. Field of the Invention

The present invention relates to an image forming apparatus which can form an image on a long sheet.

2. Description of Related Art

Conventionally, image forming apparatuses (such as a printer, a copier, and a facsimile machine) which can form an image on a long sheet such as a roll sheet and a continuous sheet (continuous form paper) are known. For example, an electrophotographic image forming apparatus is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing at a fixing section, whereby an image is formed on the sheet.

In the case where an image is formed on a long sheet in such an image forming apparatus, if the long sheet is kept tightly sandwiched by a fixing nip during warming-up prior to the start of image formation or during cooling-down after image formation, discoloration (burn) or deformation of the long sheet is caused due to the heat directly applied to the long sheet. Therefore, normally, in a non-image formation period during which image formation is not performed, a fixing side member (for example, a fixing roller) and a back side supporting member (for example, a pressure roller) that form a fixing nip are separated from each other (see, for example, Japanese Patent Application Laid-Open No. 2008-233770).

In addition, discoloration or deformation of a long sheet may be prevented by conveying the long sheet when, like at the time of the warming-up or the cooling-down, the fixing temperature (the temperature of a region near the fixing side member) is higher than a given temperature (a temperature that does not cause discoloration or deformation of the long sheet) but image formation is not performed.

However, in the technique in which a long sheet is kept conveyed during the warming-up and the cooling-down, the long sheet is wastefully consumed without being noticed by the user. This may make the user feel that the long sheet is consumed more than expected, and the user may become distrustful. In addition, this technique cannot be said to be favorable for the user who wants to save the consumption amount of the long sheet.

SUMMARY OF THE INVENTION

An object of the present invention is to provide an image forming apparatus which does not make the user distrustful of consumption of the long sheet for operations other than image formation.

To achieve at least one of the abovementioned objects, an image forming apparatus reflecting one aspect of the present invention includes: a sheet conveyance section configured to convey a long sheet; a toner image forming section configured to form a toner image on the long sheet conveyed by the sheet conveyance section; a fixing section configured to fix the toner image formed by the toner image forming section on the long sheet; and an information presenting section configured to display information relating to sheet conveyance, the information relating to sheet conveyance including waste sheet information indicating a conveyance amount of the long sheet conveyed by the sheet conveyance section during a non-image formation period.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 7A illustrates exemplary information relating to sheet conveyance that is displayed on a display section during the image formation process; and FIG. 7B illustrates exemplary information relating to sheet conveyance that is displayed on the display section during the image formation process.

DESCRIPTION OF THE PREFERRED EMBODIMENTS

Figure 1:
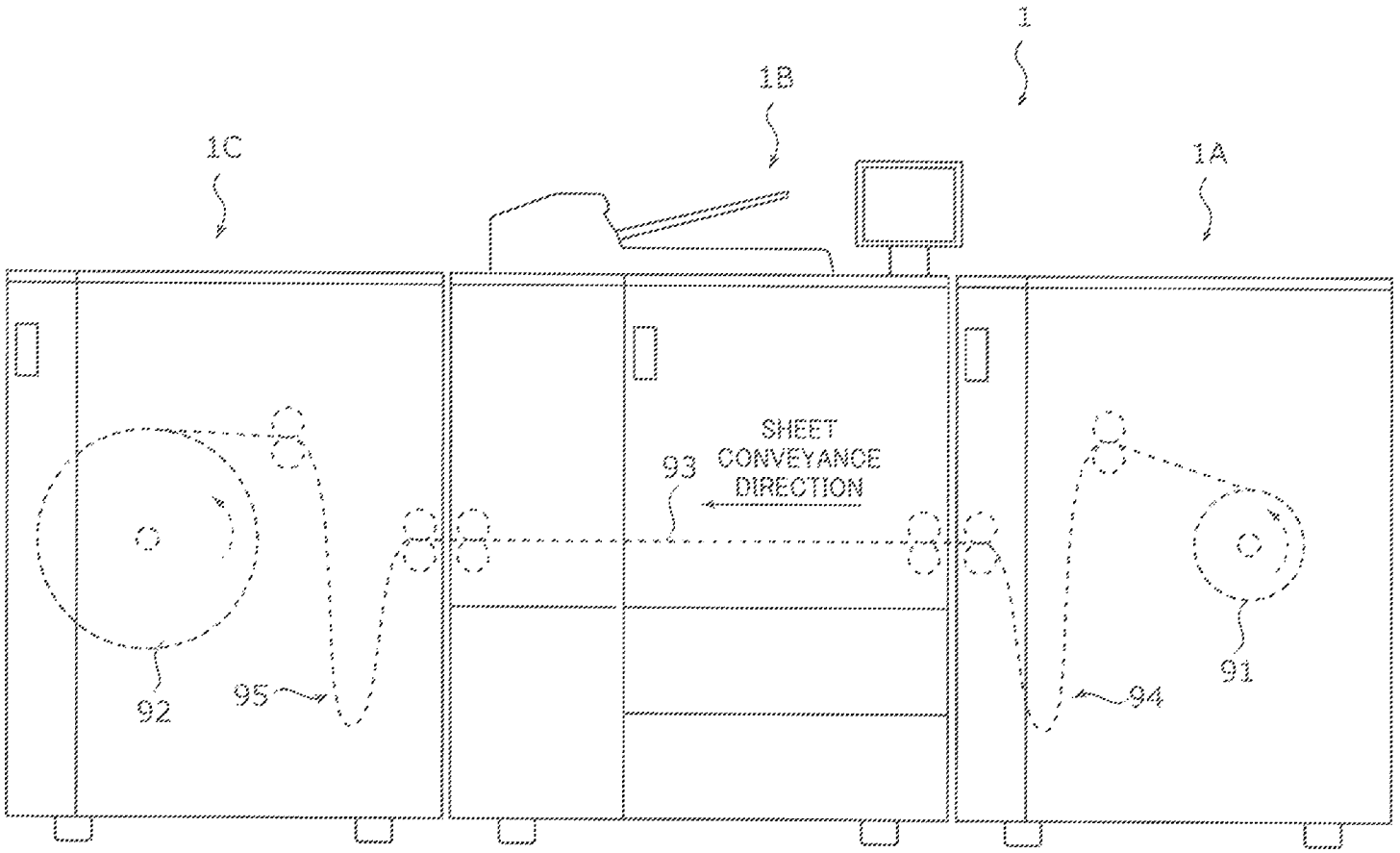
FIG. 1 illustrates an image formation system according to an embodiment of the present invention.

FIG. 1 illustrates image formation system 1 according to an embodiment of the present invention.

Image formation system 1 illustrated in FIG. 1 includes sheet feeding apparatus 1A, image forming apparatus 1B, and winding apparatus 1C. Image formation system 1 forms an image on a roll sheet, and the present invention is suitable for a case where an image is formed on a long sheet such as a roll sheet and a continuous sheet, that is, a sheet which can be brought into a stand-by state while being kept in a sheet feeding path.

Sheet feeding apparatus 1A includes roll sheet feeding section 91, sheet feeding side buffer section 94 and the like, and feeds a sheet under the instruction of image forming apparatus 1B. In sheet feeding side buffer section 94, for example, slackening of the roll sheet is absorbed with a vertically movable tension roller, an air blasting device that applies air to the roll sheet, a suction device that sucks the roll sheet or the like, and thus a proper tensile force is given to the roll sheet.

The roll sheet fed from sheet feeding apparatus 1A is conveyed along sheet feeding path 93. Image forming apparatus 1B forms an image on a roll sheet fed from sheet feeding apparatus 1A with use of an electrophotographic technique.

Winding apparatus 1C includes roll winding section 92 and winding side buffer section 95, and winds up a roll sheet on which an image has been formed by image forming apparatus 1B. Winding side buffer section 95 has a configuration similar to that of sheet feeding side buffer section 94.

Figure 2:
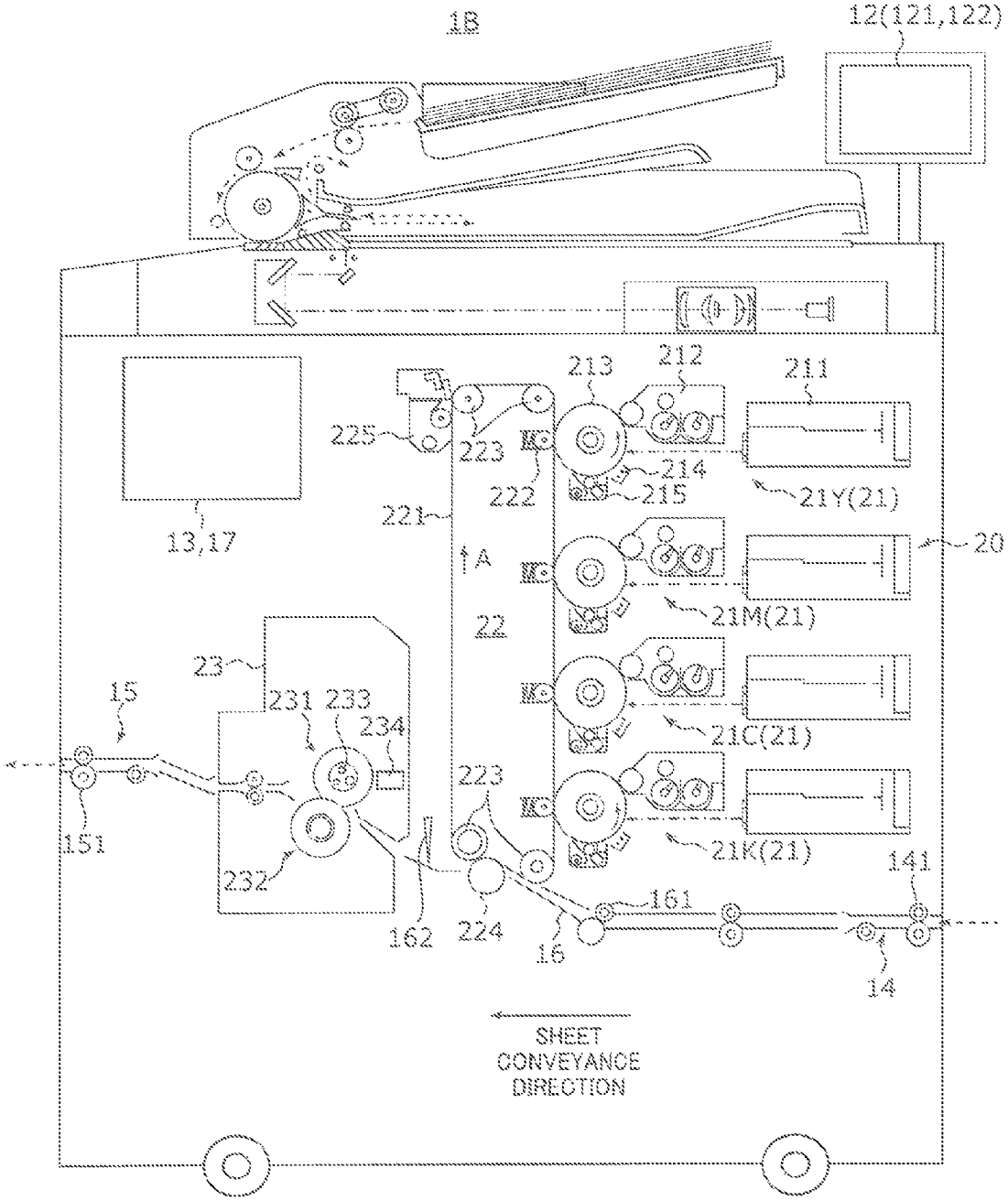
FIG. 2 illustrates a general configuration of an image forming apparatus.

FIG. 2 illustrates a general configuration of image forming apparatus 1B.

Figure 3:
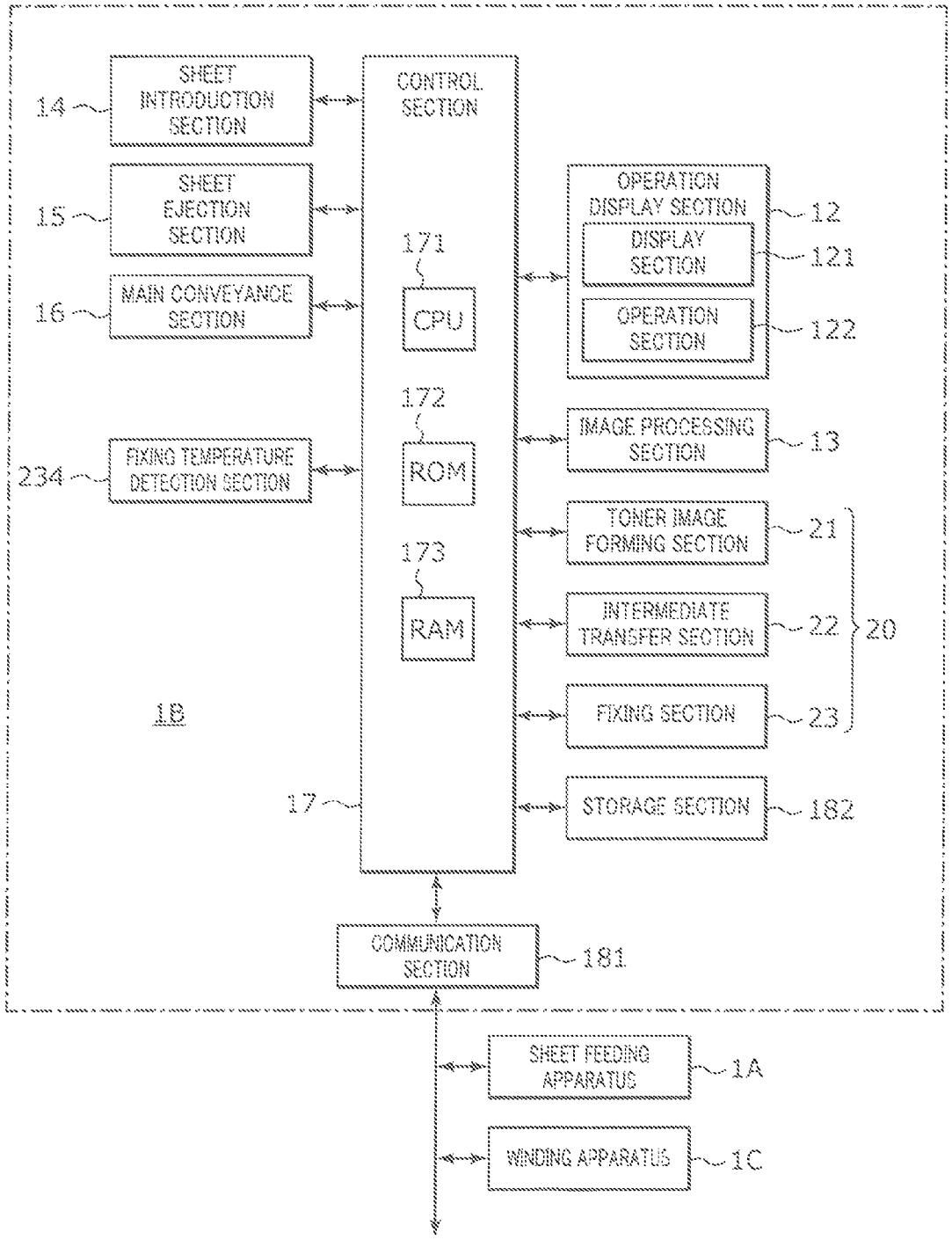
FIG. 3 illustrates a principal part of a control system of the image forming apparatus.

FIG. 3 illustrates a principal part of a control system of image forming apparatus 1B. Image forming apparatus 1B illustrated in FIGS. 2 and 3 is a color image forming apparatus of an intermediate transfer system using electrophotographic process technology. A longitudinal tandem system is adopted for image forming apparatus 1B. In the longitudinal tandem system, respective photoconductor drums 213 corresponding to the four colors of YMCK are placed in series in the travelling direction (vertical direction) of intermediate transfer belt 221, and the toner images of the four colors are sequentially transferred to intermediate transfer belt 221 in one cycle.

That is, image forming apparatus 1B primarily-transfers respective toner images of yellow (Y), magenta (M), cyan (C), and black (K) formed on photoconductor drums 213 to intermediate transfer belt 221, and superimposes the toner images of the four colors on one another on intermediate transfer belt 221. Then, image forming apparatus 1B secondarily-transfers the resultant image to a sheet, to thereby form an image.

As illustrated in FIGS. 2 and 3, image forming apparatus 1B includes operation display section 12, image processing section 13, image forming section 20, sheet introduction section 14, sheet ejection section 15, main conveyance section 16, and control section 17.

Control section 17 includes central processing unit (CPU) 171, read only memory (ROM) 172, random access memory (RAM) 173 and the like. CPU 171 reads a program suited to processing contents out of ROM 172 or storage section 182, develops the program in RAM 173, and integrally controls the operation of each block of image forming apparatus 1B, sheet feeding apparatus 1A and winding apparatus 1C in cooperation with the developed program.

Communication section 181 has various interfaces such as network interface card (NIC), modulator-demodulator (MODEM), and universal serial bus (USB), for example. Storage section 182 is composed of, for example, a non-volatile semiconductor memory (so-called flash memory) or a hard disk drive. Storage section 182 stores therein a look-up table which is referenced when the operation of each block is controlled, for example.

Control section 17 transmits and receives various data to and from an external apparatus (for example, a personal computer) connected to a communication network such as a local area network (LAN) or a wide area network (WAN), through communication section 181. Control section 17 receives image data (input image data) of page description language (PDL) that has been sent from an external device, and controls the apparatus to form an image on a sheet on the basis of the data, for example.

Operation display section 12 includes, for example, a liquid crystal display (LCD) with a touch panel, and functions as display section 121 and operation section 122. Display section 121 displays various operation screens, image conditions, operating statuses of functions, and the like in accordance with display control signals received from control section 17. Operation section 122 includes various operation keys such as numeric keys and a start key, receives various input operations performed by a user, and outputs operation signals to control section 17. By operating operation display section 12, the user can perform setting relating to the image formation such as document setting, image quality setting, multiplying factor setting, application setting, output setting, and sheet setting.

Image processing section 13 includes a circuit that performs a digital image process suited to initial settings or user settings on the input image data, and the like. For example, image processing section 13 performs tone correction on the basis of tone correction data under the control of control section 17. Image processing section 13 also performs various correction processes such as color correction and shading correction on the input image data. Image forming section 20 is controlled on the basis of the image data that has been subjected to these processes.

Image forming section 20 includes: toner image forming section 21 configured to form toner images of colored toners respectively containing a Y component, an M component, a C component, and a K component on the basis of the input image data; intermediate transfer section 22 configured to transfer a toner image formed by toner image forming sections 21 to a sheet; fixing section 23 configured to fix a transferred toner image to a sheet; and the like.

Toner image forming section 21 includes four toner image forming sections 21Y, 21M, 21C, and 21K for the Y component, the M component, the C component, and the K component, respectively. Since toner image forming sections 21Y, 21M, 21C, and 21K have similar configurations, common elements are denoted by the same reference signs for ease of illustration and description. Only when elements need to be discriminated from one another, Y, M, C, K is added to their reference signs. In FIG. 2, reference signs are given to only the elements of toner image forming section 21Y for the Y component, and reference signs are omitted for the elements of other toner image forming sections 21M, 21C, and 21K.

Toner image forming section 21 includes exposing device 211, developing device 212, photoconductor drum 213, charging device 214, drum cleaning device 215 and the like.

Photoconductor drum 213 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 211. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 214 is composed of a corona discharging generator such as a scorotron charging device and a corotron charging device, for example. Charging device 214 evenly negatively charges the surface of photoconductor drum 213 by corona discharge.

Exposing device 211 is composed of, for example, an light-emitting diode (LED) print head including an LED array having a plurality of linearly laid out LEDs, an LPH driving section (driver IC) for driving each LED, and an lens array that brings light radiated from the LED array into an image on photoconductor drum 213, and the like. Each of the LEDs of LED array 1 corresponds to one dot of an image.

Exposure device 211 irradiates photoconductor drum 213 with light corresponding to the image of each color component. The positive charge generated in the charge generation layer of photoconductor drum 213 irradiated with light is transported to the surface of the charge transport layer, whereby the surface charge (negative charge) of photoconductor drum 213 is neutralized. Thus, an electrostatic latent image of each color component is formed on the surface of photoconductor drum 213 by the potential difference from its surroundings.

Developing device 212 stores developers of respective color components (for example, a two-component developer composed of toner and magnetic carrier). Developing device 212 attaches toner of respective color components to the surfaces of photoconductor drums 213, and visualizes the electrostatic latent image to form a toner image. To be more specific, a developing bias voltage is applied to a developer bearing member (developing roller), and an electric field is formed between photoconductor drum 213 and developer bearing member. By the potential difference between photoconductor drum 213 and the developer bearing member, the charging toner on the developer bearing member is caused to move and attach to a light exposure section on the surface of photoconductor drum 213.

Drum cleaning device 215 includes a drum cleaning blade that is brought into sliding contact with the surface of photoconductor drum 213, and removes residual toner that remains on the surface of photoconductor drum 213 after the primary transfer.

Intermediate transfer section 22 includes intermediate transfer belt 221, primary transfer roller 222, a plurality of support rollers 223, secondary transfer roller 224, belt cleaning device 225 and the like.

Intermediate transfer belt 221 is composed of an endless belt, and is stretched around the plurality of support rollers 223 in a loop form. At least one of the plurality of support rollers 223 is composed of a driving roller, and the others are each composed of a driven roller. When driving roller rotates, intermediate transfer belt 221 travels in arrow A direction at a constant speed.

Primary transfer rollers 222 are disposed on the inner periphery side of intermediate transfer belt 221 in such a manner as to face photoconductor drums 213 of respective color components. Primary transfer rollers 222 are brought into pressure contact with photoconductor drums 213 with intermediate transfer belt 221 therebetween, whereby a primary transfer nip (hereinafter referred to as "primary transfer section") for transferring a toner image from photoconductor drums 213 to intermediate transfer belt 221 is formed.

Secondary transfer roller 224 is disposed on the outer periphery side of intermediate transfer belt 221 in such a manner as to face one of support rollers 223. In the plurality of support rollers 223, support roller 223 that is so disposed as to face intermediate transfer belt 221 is referred to as a backup roller (hereinafter referred to as "backup roller 223"). Secondary transfer roller 224 is brought into pressure contact with backup roller 223 with intermediate transfer belt 221 therebetween, whereby a secondary transfer nip (hereinafter referred to as "secondary transfer section") for transferring a toner image from intermediate transfer belt 221 to a sheet is formed.

In the primary transfer section, the toner images on photoconductor drums 213 are sequentially primary-transferred to intermediate transfer belt 221. To be more specific, a primary transfer bias is applied to primary transfer rollers 222, and electric charge of the polarity opposite to the polarity of the toner is applied to the rear side (the side that makes contact with primary transfer rollers 222) of intermediate transfer belt 221, whereby the toner image is electrostatically transferred to intermediate transfer belt 221.

Thereafter, when the sheet passes through the secondary transfer section, the toner image on intermediate transfer belt 221 is secondary-transferred to the sheet. To be more specific, a secondary transfer bias is applied to secondary transfer roller 224, and an electric charge opposite to that of the toner is applied to the rear side (the side that makes contact with secondary transfer roller 224) of the sheet, whereby the toner image is electrostatically transferred to the sheet. The sheet on which the toner image has been transferred is conveyed toward fixing section 23.

Belt cleaning device 225 includes a belt cleaning blade configured to make sliding contact with the surface of intermediate transfer belt 221, and the like, and removes transfer residual toner remaining on the surface of intermediate transfer belt 221 after the secondary transfer.

Alternatively, in intermediate transfer section 22, it is also possible to adopt a configuration (so-called belt-type secondary transfer unit) in which a secondary transfer belt is installed in a stretched state in a loop form around a plurality of support rollers including a secondary transfer roller in place of secondary transfer roller 224.

Fixing section 23 includes upper fixing section 231 having a fixing side member disposed on a fixing surface (the surface on which a toner image is formed) side of a sheet, lower fixing section 232 having a back side supporting member disposed on the rear surface (the surface opposite to the fixing surface) side of a sheet, heating source 233 configured to heat the fixing side member, fixing temperature detection section 234 configured to detect a temperature (fixing temperature) of a region near the fixing side member, a pressure contact separation section (not illustrated) configured to bring the back side supporting member into pressure contact with the fixing side member, and the like.

For example, when upper fixing section 231 is of a roller heating type, the fixing roller serves as the fixing side member, and when upper fixing section 231 is of a belt heating type, the fixing belt serves as the fixing side member. In addition, for example, when lower fixing section 232 is of a roller pressing type, the pressure roller serves as the back side supporting member, and when lower fixing section 232 is of a belt pressing type, the pressing belt serves as the back side supporting member. FIG. 2 illustrates a configuration in which upper fixing section 231 is of a roller heating type, and lower fixing section 232 is of a roller pressing type.

Upper fixing section 231 includes upper fixing section-driving section (not illustrated) for rotating the fixing side member. When control section 17 controls the operation of the upper fixing section-driving section, the fixing side member rotates (travels) at a predetermined speed. Lower fixing section 232 includes lower fixing section-driving section (not illustrated) for rotating the back side supporting member. When control section 17 controls the operation of the lower fixing section-driving section, the back side supporting member rotates (travels) at a predetermined speed. It is to be noted that, in the case where the fixing side member follows the rotation of the back side supporting member, the upper fixing section-driving section is not required.

Heating source 233 is disposed inside or near the fixing side member. When control section 17 controls the output of heating source 233, the fixing side member is heated, and maintained at a predetermined temperature (for example, a fixable temperature, or a fixation idling temperature). On the basis of the detection result of fixing temperature detection section 234 disposed at a position near the fixing side member, control section 17 controls the output of heating source 233.

A pressure contact separation section (not illustrated) presses the back side supporting member against the fixing side member. The pressure contact separation section makes contact with both ends of a shaft that supports the back side supporting member to separately press each end. With this structure, the balance of the nip pressure in the direction along the shaft in the fixing nip can be adjusted. When control section 17 controls the operation of the pressure contact separation section (not illustrated) such that the back side supporting member is brought into pressure contact with the fixing side member, a fixing nip for conveying a sheet in a tightly sandwiching manner is formed.

Heat and pressure are applied to a sheet on which a toner image has been secondary-transferred and which has been conveyed along a sheet feeding path at the time when the sheet passes through fixing section 23. Thus, the toner image is fixed to the sheet.

Sheet introduction section 14 includes sheet introduction roller section 141 and the like for example, and sends a roll sheet fed from sheet feeding apparatus 1A into main conveyance section 16.

Sheet ejection section 15 includes sheet ejection roller section 151 and the like for example, and sends a roll sheet output from main conveyance section 16 into winding apparatus 1C.

Main conveyance section 16 includes a plurality of conveyance roller sections serving as sheet-conveyance elements for conveying sheets in a sandwiching manner. The conveyance roller sections include entry roller section 161 disposed on the upstream side of the secondary transfer section in the sheet conveyance direction. Main conveyance section 16 conveys a roll sheet introduced from sheet introduction section 14 through image forming section 20 (a secondary transfer section and fixing section 23), and conveys a sheet output from image forming section 20 (fixing section 23) toward sheet ejection section 15.

In addition, on the upstream side of fixing section 23 in the sheet conveyance direction, main conveyance section 16 includes sheet cutting section 162 for cutting the roll sheet. Based on a request for cutting the roll sheet from the user, control section 17 controls the operation of sheet cutting section 162, and thus the roll sheet is automatically cut.

When an image is formed on a roll sheet, a roll sheet fed from sheet feeding apparatus 1A is introduced through sheet introduction section 14. The roll thus introduced is conveyed to image forming section 20 by sheet main conveyance section 16. Thereafter, a toner image on intermediate transfer belt 221 is secondary-transferred to a surface of the roll sheet at one time at the time when the roll sheet passes through the secondary transfer section, and then a fixing process is performed in fixing section 23. The roll sheet on which an image has been formed is ejected out of the apparatus from sheet ejection section 15, and wound by roll winding section 92 of winding apparatus 1C. As described, the sheet conveyance section of image forming apparatus 1B is configured by sheet introduction section 14, sheet ejection section 15, and main conveyance section 16.

Figure 4:
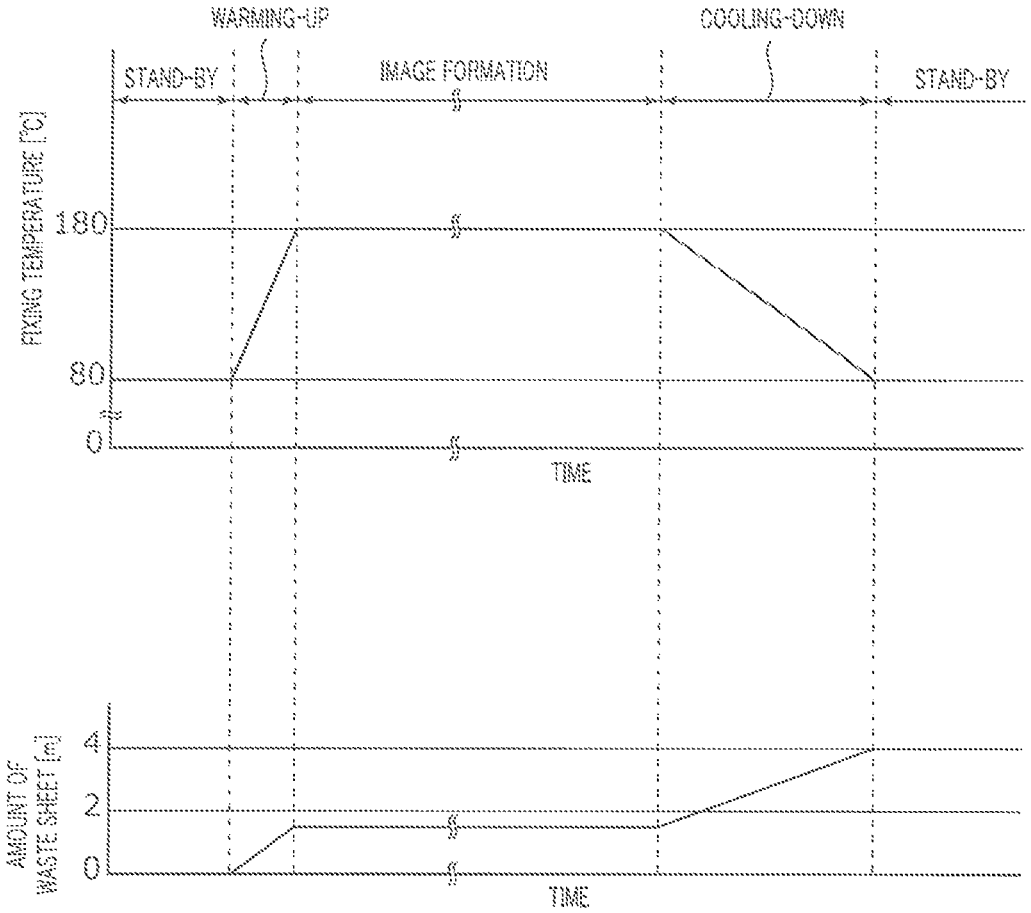
FIG. 4 shows an amount of a waste sheet generated during warming-up and cooling-down.

When image formation system 1 is in a standby state, the fixing temperature is maintained at a fixation idling temperature as illustrated in FIG. 4. The fixation idling temperature is a temperature at which a roll sheet in a staying state is not discolored or deformed, and in FIG. 4, the fixation idling temperature is 80° C. On the other hand, the fixing temperature is maintained at a fixable temperature during image formation. The fixable temperature is a temperature at which a toner image can be fixed on a roll sheet, and in FIG. 4, the fixable temperature is 180° C.

Accordingly, when a printing job is received in a standby state and image formation is started, warming-up is performed in which the fixing temperature is raised from the fixation idling temperature to the fixable temperature. In addition, when the image formation process included in the printing job is completed, cooling-down is performed in which the fixing temperature is lowered from the fixable temperature to the fixation idling temperature.

During the warming-up and the cooling-down, the fixing temperature is higher than the fixation idling temperature, and the roll sheet may be discolored or deformed, and therefore, conveyance of the roll sheet is performed although no image is formed. That is, in image forming apparatus 1B, the sheet conveyance section (sheet introduction section 14, sheet ejection section 15, and main conveyance section 16) conveys the long sheet when the fixing temperature in fixing section 23 is equal to or greater than a given temperature (fixation idling temperature) at which the long sheet is not damaged. As a result, the roll sheet is wasted to a certain degree.

In the present embodiment, information relating to sheet conveyance during the non-image formation period (for example, during the warming-up and the cooling-down) is displayed on display section 121 so that the user can recognize the information. The display of information on display section 121 is controlled by control section 17. To be more specific, control section 17 executes an information display process in accordance with the flowchart of FIG. 5. Specifically, an information presenting section of the embodiment of the present invention is composed of display section 121 and control section 17.

Here, the "information relating to sheet conveyance" includes waste sheet information indicating a conveyance amount of the roll sheet conveyed by the sheet conveyance section (sheet introduction section 14, sheet ejection section 15, and main conveyance section 16) in the non-image formation period, information for checking with the user whether to convey the roll sheet (which includes whether to cut the roll sheet) in the non-image formation period, and the like. In addition, the "sheet conveyance during the non-image formation period" includes not only sheet conveyance during the warming-up and the cooling-down, but also sheet conveyance during a sheet-setting operation for setting the roll sheet in image forming apparatus 1B.

Figure 5:
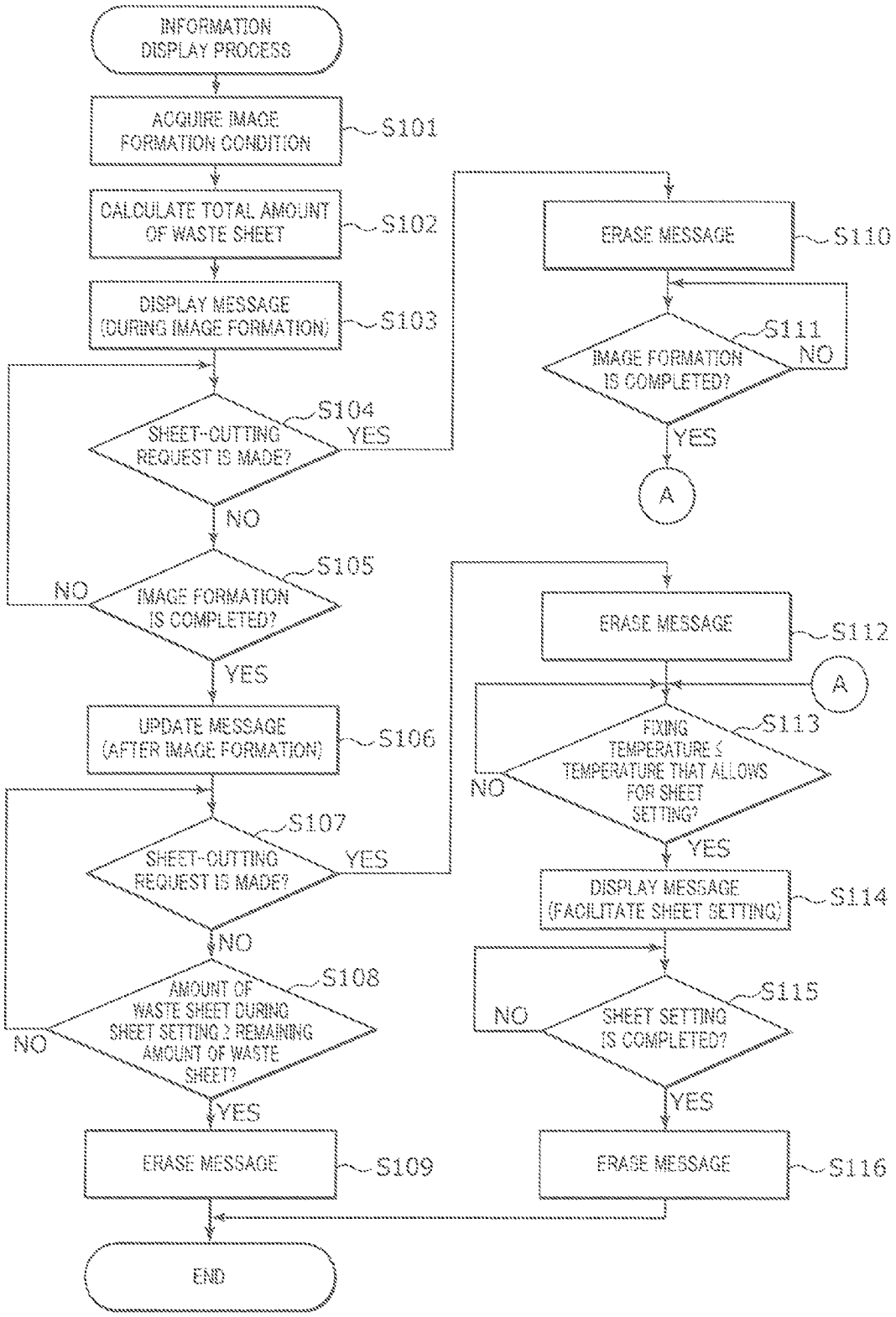
FIG. 5 is an exemplary flowchart of an information display process.

FIG. 5 is a flowchart of an exemplary information display process. This process is achieved when CPU 171 executes a predetermined program stored in ROM 172 in response to reception of printing job at image forming apparatus 1B, for example.

Upon receipt of a printing job, conveyance of a roll sheet by the sheet conveyance section (sheet introduction section 14, sheet ejection section 15, and main conveyance section 16) is started, and the warming-up in fixing section 23 is started. In addition, when the fixing temperature reaches the fixable temperature, the image formation process is started. The amount of a waste sheet keeps increasing until the warming-up is completed, and the amount of the waste sheet is constant after the image formation is started (see FIG. 4). In addition, the conveyance speed of the roll sheet during the warming-up is set at a speed lower than the conveyance speed during the image formation (for example, about 1/10 of the conveyance speed during the image formation).

At step S101, control section 17 acquires an image formation condition included in a printing job. The image formation condition includes information relating to the type of the roll sheet, and information relating to an image formation mode (normal mode/gloss mode).

At step S102, control section 17 calculates the amount of the roll sheet consumed during the warming-up and the cooling-down (hereinafter referred to as "amount of the waste sheet"). For example, to calculate the amount of the waste sheet, control section 17 refers to a table (conveyance amount information) that is preliminarily set for each type of roll sheets and stored in storage section 182.

Figure 6A:
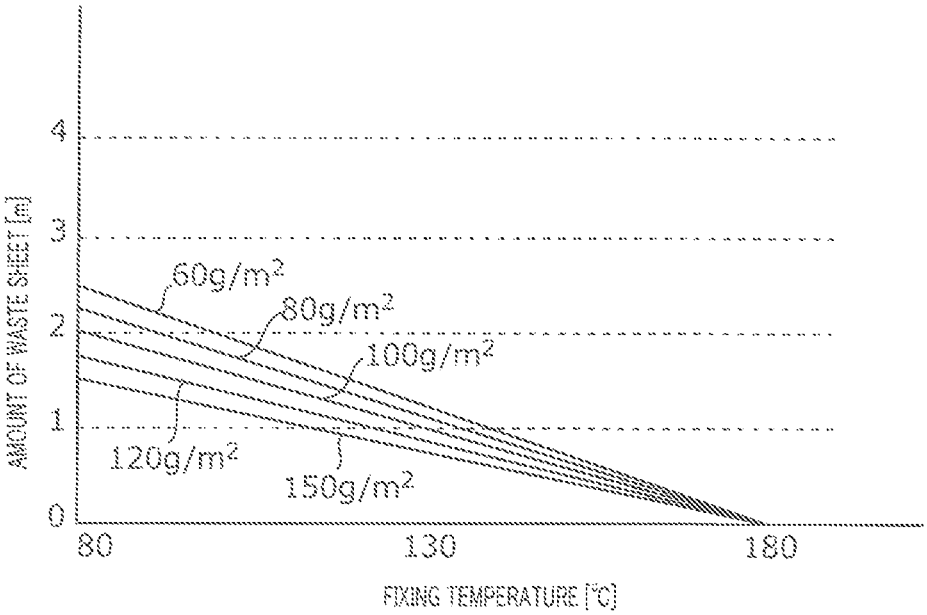
FIG. 6A is an exemplary table in which an amount of the waste sheet during warming-up is set.
Figure 6B:
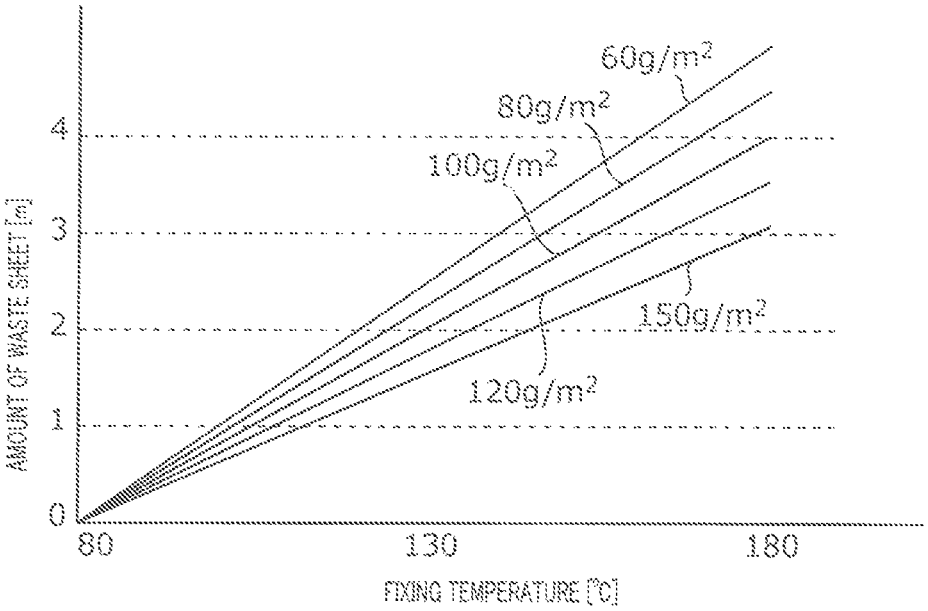
FIG. 6B is an exemplary table in which an amount of the waste sheet during cooling-down is set.

FIG. 6A shows an exemplary table in which the amount of the waste sheet during the warming-up is set, and shows a case where the fixing temperature is raised to 180° C. (a case where an image is formed in the normal mode). The fixable temperature differs depending on the image formation modes, and therefore the table is prepared for each image formation mode. FIG. 6B shows an exemplary table in which the amount of the waste sheet during the cooling-down is set, and shows a case where the fixing temperature is lowered to 80° C.

The heat-dissipation property and the like of the roll sheet differ depending on the type of the roll sheet, and therefore the amount of the waste sheet consumed during the warming-up and the cooling-down differs even when the same fixable temperature is used. For example, the greater the basis weight of the roll sheet, the slower the conveyance speed required at the time of the warming-up and the cooling-down, and therefore the smaller the amount of the waste sheet.

According to FIG. 6A, in a case of a roll sheet having a basis weight of 150 g/m$^2$, the amount of the waste sheet consumed by warming-up for raising the fixing temperature from 80° C. to 180° C. is 1.5 m, for example. According to FIG. 6B, in a case of a roll sheet having a basis weight of 150 g/m$^2$, the amount of the waste sheet consumed by cooling-down for lowering the fixing temperature from 180° C. to 80° C. is 3 m, for example. That is, in the case of the roll sheet having a basis weight of 150 g/m$^2$, the total amount of the waste sheet consumed by the warming-up and the cooling-down is 4.5 m.

At step S103, control section 17 controls display section 121 to display information relating to the sheet conveyance during the non-image formation period. During image formation, a message shown in FIG. 7A is displayed, for example. The message shown in FIG. 7A includes message M1 indicating the amount of the waste sheet consumed during the warming-up and the cooling-down (total amount of the waste sheet) as waste sheet information, and message M2 indicating that the consumption amount can be saved by cutting the roll sheet at the time of the cooling-down. To receive request for cutting roll sheet from the user, a sheet-cutting button is disposed in operation section 122.

With the message of FIG. 7A displayed on display section 121, the user can readily recognize the amount of the waste sheet consumed during the warming-up and the cooling-down. Furthermore, the user can acquire an alternative option, that is, an idea of cutting the roll sheet at the time of the cooling-down, and thus the user can appropriately select the alternative option when reduction of the consumption amount is desired.

It is to be noted that the process of step S103 only has to be performed in a period before the image formation process of a first printing job is completed (or before the image formation process of the final printing job is completed in a case where a plurality of printing jobs are received) and after the first printing job is received.

At step S104, based on operation information indicating that the sheet-cutting button has been operated, control section 17 determines whether a request for cutting the roll sheet has been made by the user. When the sheet-cutting request has been made ("YES" at step S104), the process is advanced to step S110. When the sheet-cutting request has not been made ("NO" at step S104), the process is advanced to step S105.

At step S105, control section 17 determines whether all image formation processes (the image formation process of the final job when a plurality of printing jobs have been received) included in the received printing job have been completed. When the image formation processes have been completed, the process is advanced to step S106. When the image formation processes have not been completed, the process is advanced to step S104. That is, when the request for cutting the roll sheet is not made by the user, the message shown in FIG. 7A is displayed until the image formation processes are completed. In this manner, the user can recognize the amount of the waste sheet during the image formation.

When the image formation processes are completed, the cooling-down in fixing section 23 is started, thus increasing the amount of the waste sheet. In addition, the conveyance speed of the roll sheet at the time of the cooling-down is set to a speed slower than the conveyance speed during the image formation.

At step S106, control section 17 updates the information relating to the sheet conveyance during the non-image formation period displayed on display section 121. After the image formation, the message shown in FIG. 7B is displayed for example. The message shown in FIG. 7B includes message M3 indicating a remaining amount of roll sheet consumed during the cooling-down (remaining amount of the waste sheet) as waste sheet information, and message M2 indicating that the consumption amount can be saved by cutting the roll sheet. The remaining amount of the waste sheet can be calculated by subtracting the amount of the conveyed sheet (measured value) from the total amount of the waste sheet (calculated value). Since the amount of the waste sheet may possibly be saved by cutting the roll sheet even during the cooling-down, the display of message M2 is continued.

By displaying in real time the remaining amount of the waste sheet as the waste sheet information in the message displayed after the image formation (see FIG. 7B), the user can readily recognize the remaining amount of the waste sheet to be consumed, and can use the message to determine whether to cut the roll sheet.

At step S107, based on operation information indicating that the sheet-cutting button has been operated, control section 17 determines whether a request for cutting the roll sheet has been made by the user. When the sheet-cutting request has not been made ("NO" at step S107), the process is advanced to step S108. When the sheet-cutting request has been made ("YES" at step S107), the process is advanced to step S112. In addition, the roll sheet is promptly cut by sheet cutting section 162, and the conveyance of the roll sheet is stopped. The roll sheet on the downstream side of sheet cutting section 162 in the sheet conveyance direction is immediately ejected (paper ejection).

At step S108, control section 17 determines whether the amount of the waste sheet (the amount of the waste sheet during the sheet setting) required for the sheet-setting operation performed in the case where the roll sheet is cut is not smaller than the amount of the waste sheet (the remaining amount of the waste sheet) required in the case where conveyance of the roll sheet is continued. When the roll sheet is cut, a waste sheet (for example, 2 m) is generated during the sheet-setting operation of the roll sheet performed after the cooling-down although no waste sheet is generated during the cooling-down. At step S108, it is determined which of continuing the conveyance of the roll sheet and cutting the roll sheet can reduce the amount of the waste sheet more than the other. When the amount of the waste sheet during the sheet setting is greater than the remaining amount of the waste sheet, that is, when the amount of the waste sheet cannot be reduced even by cutting the roll sheet, the process is advanced to step S109. When the amount of the waste sheet during the sheet setting is smaller than the remaining amount of the waste sheet, that is, the amount of the waste sheet can be reduced by cutting the sheet more than the case where the conveyance of the roll sheet is continued, the process is advanced to step S107.

At step S109, control section 17 erases the message (see FIG. 7B) on the display. It is to be noted that control section 17 may erase the message on the display after the fixing temperature is cooled down to the fixation idling temperature. When the fixing temperature reaches the fixation idling temperature and the cooling-down is completed, the conveyance of the roll sheet is stopped, and a standby state is established.

When the sheet-cutting request is made by the user during image formation ("YES" at step S104), control section 17 erases the message (see FIG. 7A) on the display at step S110. Since the information relating to sheet conveyance is unnecessary for the user who has made the sheet-cutting request, it is preferable to display other useful information after the sheet-cutting request has been made.

At step S111, control section 17 determines whether all image formation processes included in the received printing job (the image formation process of the final job when a plurality of printing jobs are received) have been completed. When the image formation processes are completed, the process is advanced to step S113. In addition, when image formation processes have been completed, the cooling-down in fixing section 23 is started, and the roll sheet is cut by sheet cutting section 162, and then, the conveyance of the roll sheet is stopped. The roll sheet on the downstream side of sheet cutting section 162 in the sheet conveyance direction is immediately ejected (paper ejection).

When the sheet-cutting request is made by the user after the image formation ("YES" at step S107), control section 17 erases the message (see FIG. 7B) on the display at step S112.

When the cutting of the roll sheet has been performed, control section 17 determines whether the fixing temperature has been changed to a temperature (for example, 60° C.) or lower that allows for sheet setting at step S113. When the fixing temperature is at the temperature or lower that allows for sheet setting, the process is advanced to step S114.

At step S114, control section 17 controls display section 121 to display a message that facilitates the user to set the roll sheet. By notifying the user of the fact that the interior of image forming apparatus 1B has a safe temperature, the sheet-setting operation for the next image formation process can be facilitated.

At step S115, control section 17 determines whether the setting of the roll sheet has been performed. When the setting of the roll sheet has been completed, the process is advanced to step S116. It is to be noted that when the sheet-setting operation has been completed, a standby state is established after the fixing temperature is raised to the fixation idling temperature.

At step S116, control section 17 erases the message on the display. In the above-mentioned manner, the information display process in display section 121 is performed.

It is to be noted that, when another printing job is received during the information display process of FIG. 5, the process is again performed from step S101, and the waste sheet information is reset. For example, when another printing job is received during image formation processes of a printing job that has already been received, the amount of the waste sheet during the cooling-down is reset, and the total amount of the waste sheet is rewritten. In addition, for example, when another printing job is received during the cooling-down, a newly calculated amount of the waste sheet during the warming-up and the cooling-down is added to the amount of the waste sheet that has been consumed, and the amount thus calculated is displayed as the total amount of the waste sheet. In the case where a request for cutting the roll sheet has already been made by the user at the time when another printing job is newly received, it is not necessary to continuously display the information relating to the sheet conveyance.

As described, image forming apparatus 1 includes a sheet conveyance section (sheet introduction section 14, sheet ejection section 15 and main conveyance section 16) configured to convey a long sheet (roll sheet); a toner image forming section (toner image forming section 21 and intermediate transfer section 22) configured to form a toner image on the long sheet conveyed by sheet conveyance section (14, 15 and 16); fixing section 23 configured to fix the toner image formed by the toner image forming section (21 and 22) on the long sheet; and an information presenting section (display section 121 and control section 17) configured to display information relating to sheet conveyance, the information relating to sheet conveyance including waste sheet information indicating a conveyance amount of the long sheet conveyed by sheet conveyance section (14, 15 and 16) during a non-image formation period.

According to image forming apparatus 1, when the long sheet is wastefully consumed for operations other than the image formation, the user can readily recognize the waste of the sheet, and the amount of the waste sheet. Thus, the user is not made distrustful of consumption of the long sheet that is beyond expectation.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, when the roll sheet is conveyed and a waste sheet is generated in image forming apparatus 1B during the non-image formation period other than the operations for the warming-up and the cooling-down (for example, a sheet-setting operation at the time of exchanging the roll sheet), the conveyance amount at this time may be displayed as the waste sheet information. In addition, the amount of the waste sheet generated during the non-image formation period may be updated in real time.

In the embodiment, whether to cut the roll sheet can be selected after the image formation is completed. Alternatively, whether to stop the roll sheet may be selected if the user is willing to accept discoloration or deformation of the roll sheet.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a sheet conveyance section configured to convey a long sheet;

a toner image forming section configured to form a toner image on the long sheet conveyed by the sheet conveyance section;

a fixing section configured to fix the toner image formed by the toner image forming section on the long sheet; and an information presenting section configured to display information relating to sheet conveyance, the information relating to sheet conveyance including waste sheet information indicating a conveyance amount of the long sheet conveyed by the sheet conveyance section during a non-image formation period.

2. The image forming apparatus according to claim 1, wherein the sheet conveyance section conveys the long sheet when a fixing temperature in the fixing section is equal to or higher than a given temperature at which the long sheet is not damaged.

3. The image forming apparatus according to claim 2, wherein the waste sheet information includes a conveyance amount of the long sheet when the fixing temperature is lowered to the given temperature after an image formation process is completed.

4. The image forming apparatus according to claim 3, wherein the information presenting section calculates the conveyance amount of the long sheet based on conveyance amount information preliminarily set for each sheet type of the long sheet.

5. The image forming apparatus according to claim 2, wherein the information presenting section displays the information relating to sheet conveyance in a period after a first printing job is received and before an image formation process of a final printing job is completed.

6. The image forming apparatus according to claim 2, wherein the information presenting section updates the information relating to sheet conveyance in real time.

7. The image forming apparatus according to claim 2 further comprising an operation section configured to receive information input by a user, wherein:

the information relating to sheet conveyance includes information for allowing the user to select whether to continue conveyance of the long sheet of the sheet conveyance section after the image formation process is completed; and the sheet conveyance section stops the conveyance of the long sheet when information indicating that the conveyance of the long sheet is not continued is received by the operation section.

8. The image forming apparatus according to claim 7 further comprising a sheet cutting section configured to cut the long sheet at a position on an upstream side of the fixing section in a sheet conveyance direction, wherein:

the information relating to sheet conveyance includes information for allowing the user to select whether to cut the long sheet after the image formation process is completed; and the sheet conveyance section stops the conveyance of the long sheet and the sheet cutting section cuts the long sheet when information indicating that the long sheet is cut is received by the operation section.

9. The image forming apparatus according to claim 8, wherein the information presenting section displays the information relating to sheet conveyance when the conveyance amount of the long sheet included in the waste sheet information is greater than an amount of a waste sheet generated when the sheet is cut.

* * * * *